US011684186B2

(12) United States Patent
Greer et al.

(10) Patent No.: US 11,684,186 B2
(45) Date of Patent: Jun. 27, 2023

(54) PLANT CADDY SHELF

(71) Applicant: Trendstar Corporation, Fairfield, NJ (US)

(72) Inventors: Michael Alan Greer, North Royalton, OH (US); Rajesh Israni, Fairfield, NJ (US)

(73) Assignee: TRENDSTAR CORPORATION, Fairfield, NJ (US)

( * ) Notice: Subject to any disclaimer, the term of this patent is extended or adjusted under 35 U.S.C. 154(b) by 1 day.

(21) Appl. No.: 17/411,777

(22) Filed: Aug. 25, 2021

(65) Prior Publication Data

US 2022/0061556 A1 Mar. 3, 2022

Related U.S. Application Data

(60) Provisional application No. 63/161,572, filed on Mar. 16, 2021, provisional application No. 63/069,732, filed on Aug. 25, 2020.

(51) Int. Cl.
*A47G 7/04* (2006.01)

(52) U.S. Cl.
CPC ..... *A47G 7/041* (2013.01)

(58) Field of Classification Search
USPC ..... 47/39, 67, 68, 40; 211/87.1, 88, 1, 2, 3, 211/90.1; 108/46, 152; 119/706, 28.5
See application file for complete search history.

(56) References Cited

U.S. PATENT DOCUMENTS 312,159 A * 2/1865 Perkins
342,476 A * 5/1886 Swartwout
477,355 A * 6/1892 Curtis et al.
1,224,127 A * 5/1917 Bartlett ..... A47B 96/061 182/62
1,558,977 A * 10/1925 Alexander ..... A47B 5/04 248/300
1,786,995 A * 12/1930 Halberstadter ..... A47G 7/044 248/221.11
1,809,216 A * 6/1931 Quandt ..... A47H 27/00 248/300
1,914,617 A * 6/1933 Rogers ..... A47G 7/044 211/88.03
1,989,294 A * 1/1935 Serpigo ..... A47G 7/044 211/88.03
2,029,246 A * 1/1936 Mccarroll ..... A47G 7/044 248/208
2,544,203 A * 3/1951 Watkins ..... A47J 47/16 248/236
2,911,108 A * 11/1959 Nield ..... A47F 5/08 108/159
4,869,451 A * 9/1989 Gordon ..... A47H 27/00 D30/118

(Continued)

*Primary Examiner* — Andrea M Valenti
(74) *Attorney, Agent, or Firm* — Leason Ellis LLP

(57) ABSTRACT

An article in the form of a plant caddy shelf for supporting a plant includes a main support platform that is configured for placement on a top surface of a window sill. The main support platform has an area for receiving a plant pot. The area includes a drain hole. A leg support is pivotally coupled to an underside of the main support platform and including a bottom end for coupling to a support surface. A removable drip tray is removably coupled to the underside of the main support platform and is in fluid communication with the drain hole.

15 Claims, 16 Drawing Sheets

(56) References Cited

U.S. PATENT DOCUMENTS

| | | | | | |
|---|---|---|---|---|---|
| D366,799 | S | * | 2/1996 | Curtin | D6/574 |
| 5,826,851 | A | * | 10/1998 | Arbisi | A47G 1/17 40/594 |
| D938,189 | S | * | 12/2021 | Kalman | D6/555 |
| 2006/0236896 | A1 | * | 10/2006 | Heroux | A01K 1/035 108/11 |
| 2008/0134430 | A1 | * | 6/2008 | Kirmon | A01K 1/035 5/10.1 |

* cited by examiner

PLANT CADDY SHELF

CROSS REFERENCE TO RELATED APPLICATIONS

The present application claims priority to and the benefit of U.S. patent application No. 63/069,732, filed Aug. 25, 2020, and U.S. patent application No. 63/161,572, filed Mar. 16, 2021, each of which is hereby incorporated by reference in its entirety.

Technical Field

The present invention is directed to plant holders and more particularly, to an article that is configured to mount to a wall or be installed on a window sill and includes a built in drip tray to capture any excess water that leaks from the plant pot itself after watering.

BACKGROUND

As is well known, plants need light to grown and therefore are often position at or near a window. To protect the underlying support surface, a potted plant is often placed in a protective tray or a wheeled caddy for larger plants, etc. It is not possible for most sized plants to be placed on a window sill since they are too large. Given that the window seal is part of window that lets in light, a window sill is an ideal location for a plant.

SUMMARY

An article for supporting a plant is provided and includes a main support platform that is configured for placement on a top surface of a window sill. The main support platform has an area for receiving a plant pot. The area includes a drain hole. A leg support is pivotally coupled to an underside of the main support platform and including a bottom end for coupling to a support surface. A removable drip tray is removably coupled to the underside of the main support platform and is in fluid communication with the drain hole.

BRIEF DESCRIPTION OF THE DRAWING FIGURES

DETAILED DESCRIPTION OF CERTAIN EMBODIMENTS

Figure 1:
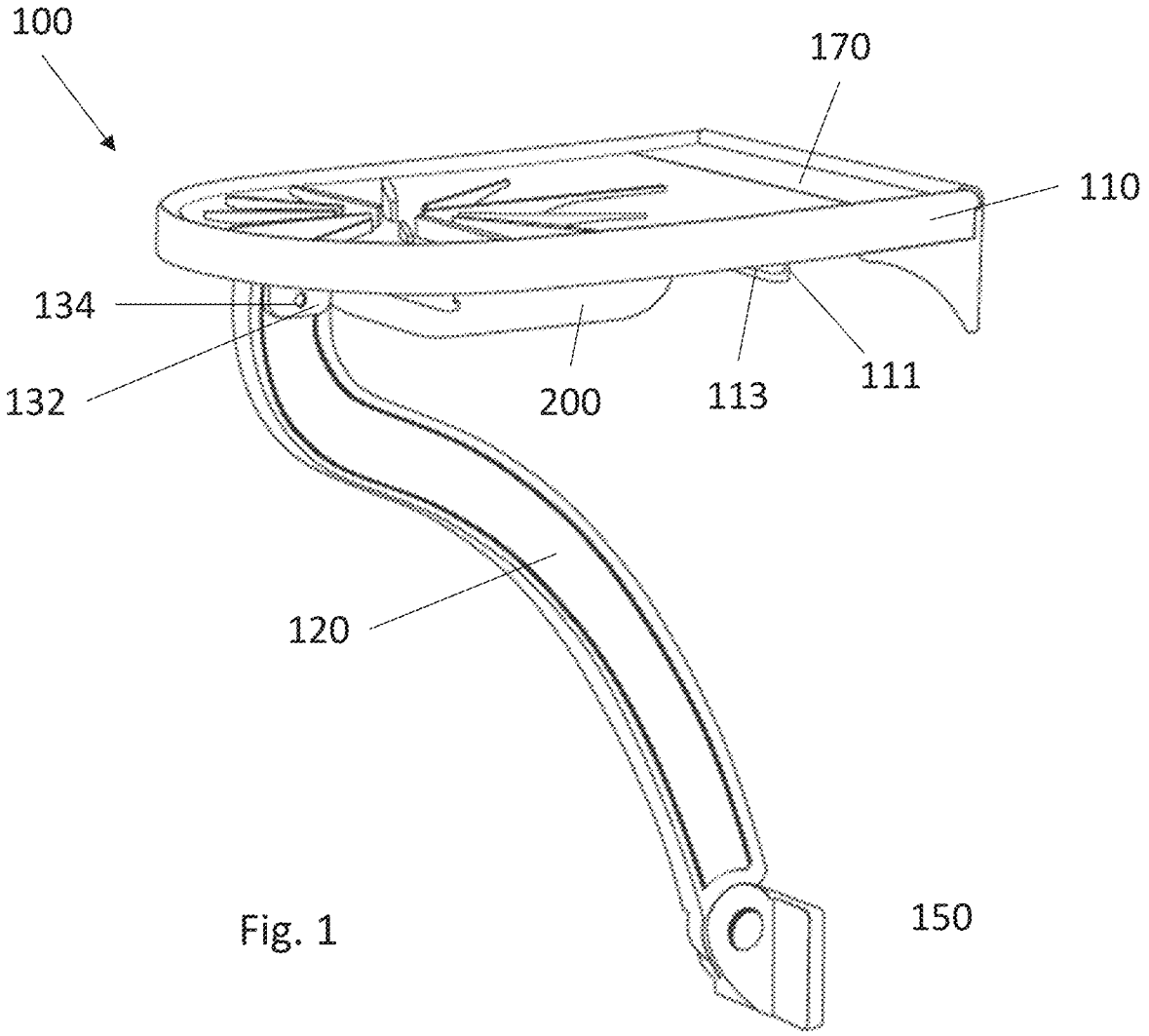
FIG. 1 is front and side perspective view of a plant caddy shelf according to one embodiment.

Now turning to FIGS. 1-9 in which a plant caddy shelf 100 according to a first embodiment is shown. The plant caddy shelf 100 is configured for installation at window sill 10 of a conventional house window.

The plant caddy shelf 100 includes a main platform 110 (main support member) and a pivotable support leg (shelf support) 120 that is attached to the main platform 110. The main platform 110 is configured to be placed and installed on the window sill 10 as illustrated and provides a surface on which a plant (pot) is placed. The main platform 110 has a top surface 112 and an opposing bottom surface 114. The main platform 110 has a raised perimeter lip (peripheral edge) 115 that prevents the plant from sliding off the main platform 110. As shown, the main platform 110 can have a curved front and a straight (linear) rear along with straight parallel sides.

The top surface 112 can include other features to ensure that the plant remain in place on the top surface 112. For example, the top surface 112 can include a plurality of raised ribs 117 that can be arranged in a pattern (e.g., the spoked pattern as illustrated) and define a surface on which the pot rests. The ribs 117 can be integrally formed as by a common molding process in which the entire main platform 110 is formed.

The main platform 110 also includes a drain hole 119 that is a through hole that passes through the main platform 110. As shown, the drain hole 119 is preferably formed in the surface area on which the plant rests. For example, the drain hole 119 can be formed centrally and located in the center of the raised ribs 117. The drain hole 119 is configured to permit liquid (water) to flow by gravity.

Along the bottom surface 114 of the main platform 110, there is a first coupling member 130 that comprises a pair of upstanding walls 132 that are spaced apart and parallel to one another. Each of the upstanding walls 132 has an open notch or a hole 134 (as illustrated) formed therein. The upstanding walls 132 are located proximate the curved front end of the main platform 110. The two holes 134 are across from one another and define a common first axis.

The bottom surface 114 of the main platform 110 can contain one or more locating walls or ribs (rails) 111. The locating walls 111 extend transversely from one side to the other side of the main platform 110. The locating walls 111 can be linear ridges that are formed perpendicular to the bottom surface 114 and extend downwardly when the main platform 110 is positioned in its intended position with the bottom surface 114 facing downward. Each of the locating walls 111 can have an L-shape in that the bottom edges of the wall 111 has an inwardly directed lip 113. The two inwardly directed lips 113 face one another.

The main platform 110 can also include a removable back plate 170 that is part of the main platform 110. Removal of the back plate 170 exposes an inner compartment 172 that includes holes 174. The back plate 170 defines a top rear section of the main platform 110 and defines the rear edge of the main platform 110.

The pivotable support leg 120 has a first end and an opposite second end. At the first end, the pivotable support leg 120 includes a second coupling member 140 in the form of a pair of protrusions (pins) 142 that extend and face outwardly from two opposite sides of the second coupling member 140. The two protrusions 142 are formed along a common second axis.

As shown, the pivotable support leg 120 is not a completely linear structure but rather is a curved structure and more particularly, is defined by several curves and can be considered to broadly have an S shape.

At the opposite second end, the pivotable support leg 120 is pivotally coupled to a leg bracket 150. The leg bracket 150 has a mounting portion 152 that is configured to seat against a support surface, such as a wall, as described herein. The mounting portion 152 is integrally attached to a finger portion 154 that has a center slot that receives the second end of the pivotable support leg 120. A pin or axle 160 is provided for pivotally attaching the second end of the pivotable support leg 120 to the leg bracket 150.

A drip tray 200 is also provided to detachably and removably mate with the main platform 110 for capturing any liquid that passes through the drain hole 119. The drip tray 200 has a receptacle body 210 with a top lip 212 at each of its ends. The drip tray 200 is constructed to be coupled to the bottom surface 114 of the main platform 110 by a sliding action. In particular, the top lip 212 of the drip tray 200 is positioned above the inwardly directed lips 113 of the walls 111. The drip tray 200 is slid into position beneath the main platform 110 such that it lies below the drain hole 119. The drip tray 200 is thus supported and hangs from the inwardly directed lips 113. When the drip tray 200 fills, the user can remove it for emptying. The drip tray 200 is thus located between the two walls 111. The drip tray 200 should sit centered under the main platform (shelf) 110.

The plant caddy shelf 100 can also come with a wall bracket 300 for instances in which the user prefers to mount the plant caddy shelf 100 to a support surface, such as a wall, instead of a window sill. The wall bracket 300 is an elongated structure that has a back wall 310 with a pair of end walls 320 that oriented perpendicular to the back wall 310. Each end wall 320 has an upstanding end tab 325 that extends above the top edge of the back wall 310. The end tab 325 can be integrally formed with the end wall 320 and thus represents an integral section thereof. The end tabs 325 function as wall bracket tabs. Between the two end walls 320 there are two intermediate supports 330 that have top edges that lie below the end tabs 325. The top edges of the end tabs 325 and the intermediate supports 330 are flat.

The wall bracket 300 is intended to support the main platform 110. In particular near the flat rear edge of the main platform 110, the underside (bottom surface 114) of the main platform 110 can contain slots (not shown) that receive the end tabs 325 as a means for supporting the main platform 110 along its rear section. To couple the main platform 110 to the wall bracket 300, the main platform 110 is simply lowered to cause a reception of the end tabs 325 into the slots, thereby coupling and optionally locking the main platform 110 to the wall bracket 300. The intermediate supports 330 support the inner section of the main platform 110.

The wall bracket 300 can also include one or more holes 301 that permit the user to pass a fastener, such as a screw or nail, to securely anchor the wall bracket 300 to the support surface (wall). Alternative adhesive means for securing the wall bracket 300 are described below.

Figure 2:
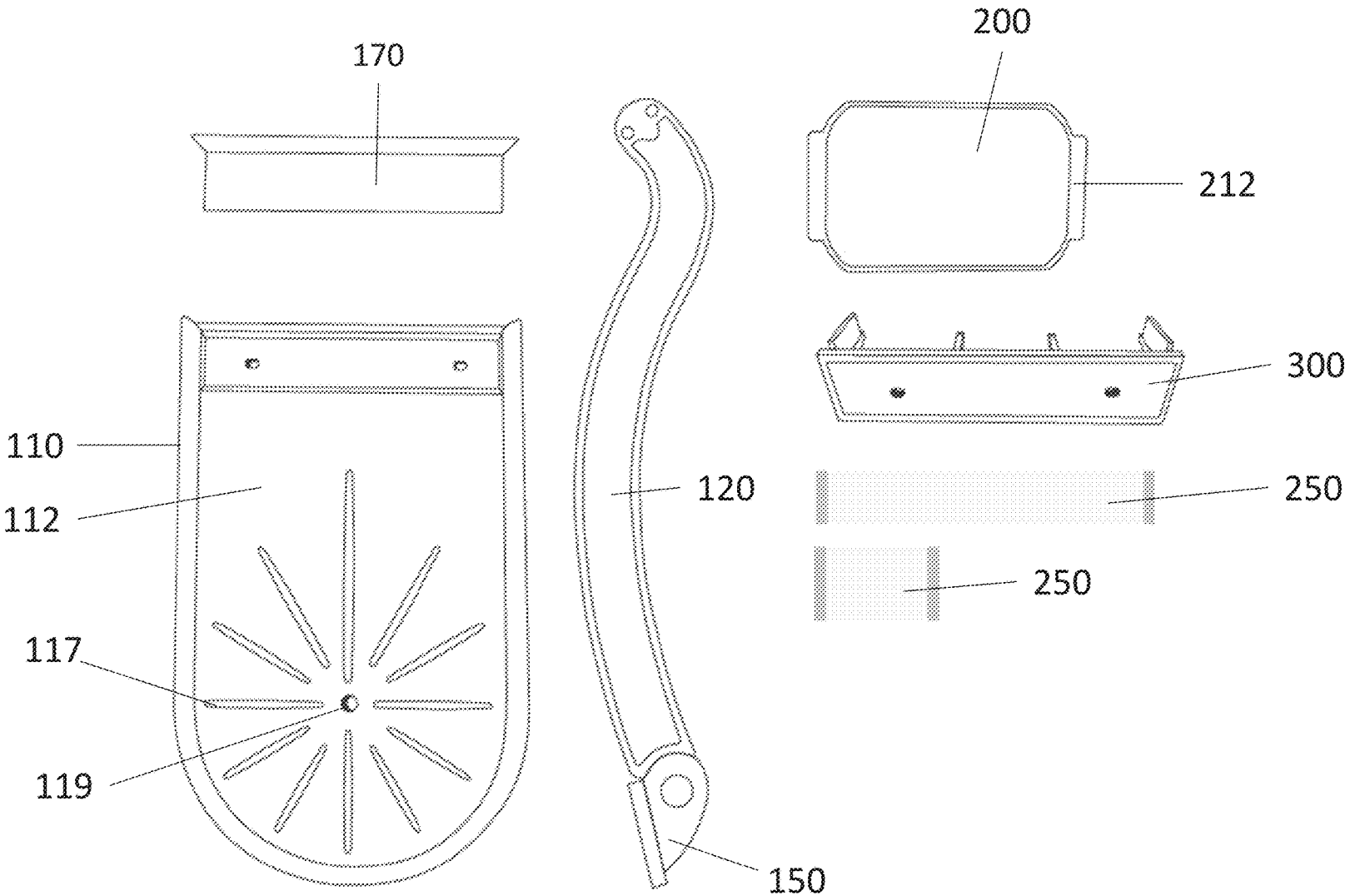
FIG. 2 is an exploded view of the plant caddy shelf.

The plant caddy shelf 100 also preferably comes with one or more fastening or joining components 250. For example, the fastening components 250 can be in the form of hook and loop fasteners, double sided tape, bonding agents, or other suitable fasteners. FIG. 2 shows a small adhesive strip (e.g., double sided tape) and a large adhesive strip (e.g., double sided tape). The small adhesive strip is configured for placement on the rear of the mounting portion 152 of the leg bracket 150 for securing this portion to the support surface (wall), while the large adhesive strip is configured for placement along the rear face of the back wall 310 of the wall bracket 300 for securing this portion to the support surface.

Figure 3:
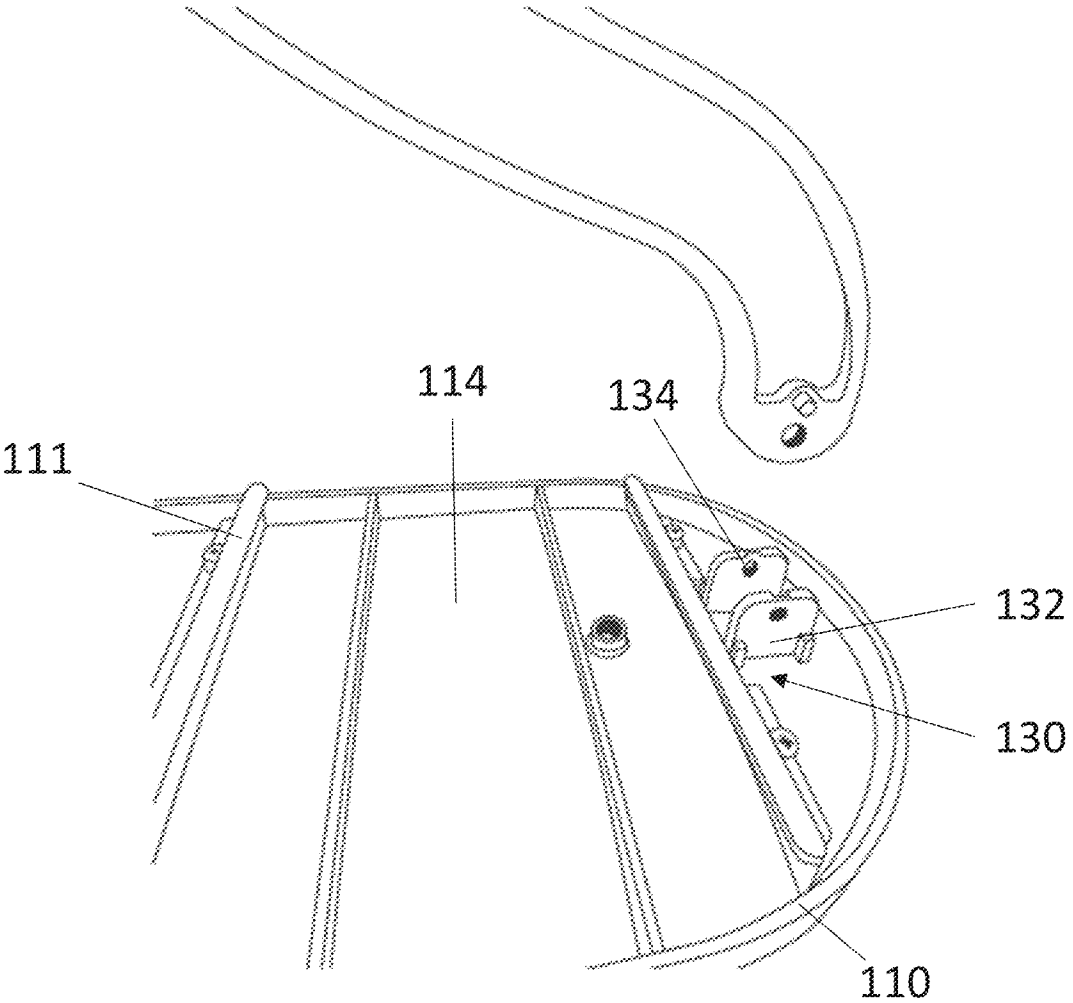
FIG. 3 is a view of a first step in assembling the plant caddy shelf.

FIG. 3 shows a first step in the installation of the plant caddy shelf 100 which involves inserting the protrusions (pins) 142 into the holes 134 as shown. This engagement can be a snap-fit in that the protrusions 142 snap-fittingly engage the walls 132 in such a way that the pivotable support leg 120 can pivot relative to the main platform 110. The walls 132 have a degree of flexing to allow receipt of the pins 142 and then when pins 142 are aligned with the holes 134, the pins 142 snap into place and the walls 132 flex back.

Figure 4:
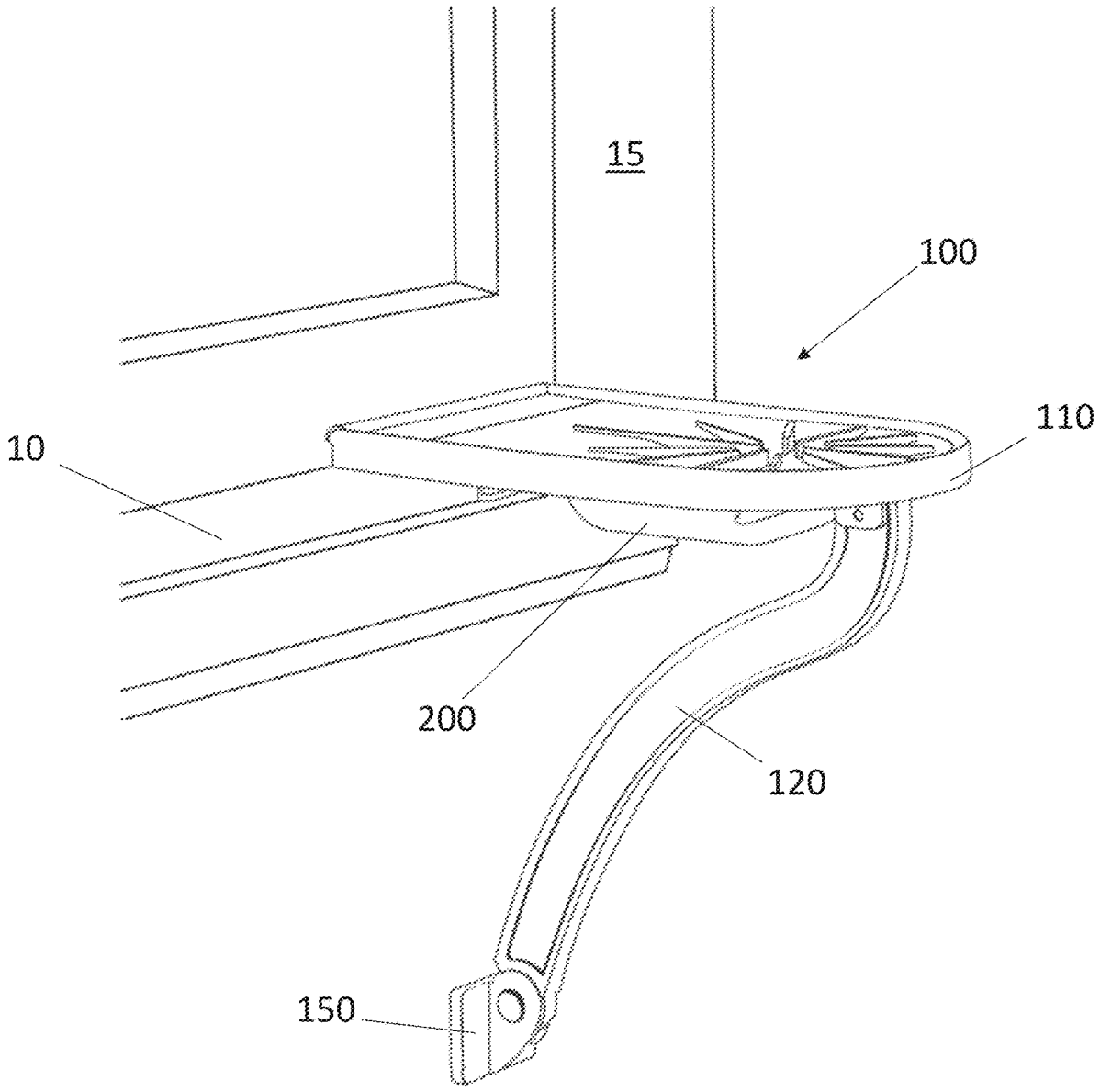
FIG. 4 is a view of a second step in assembling the plant caddy shelf.
Figure 5:
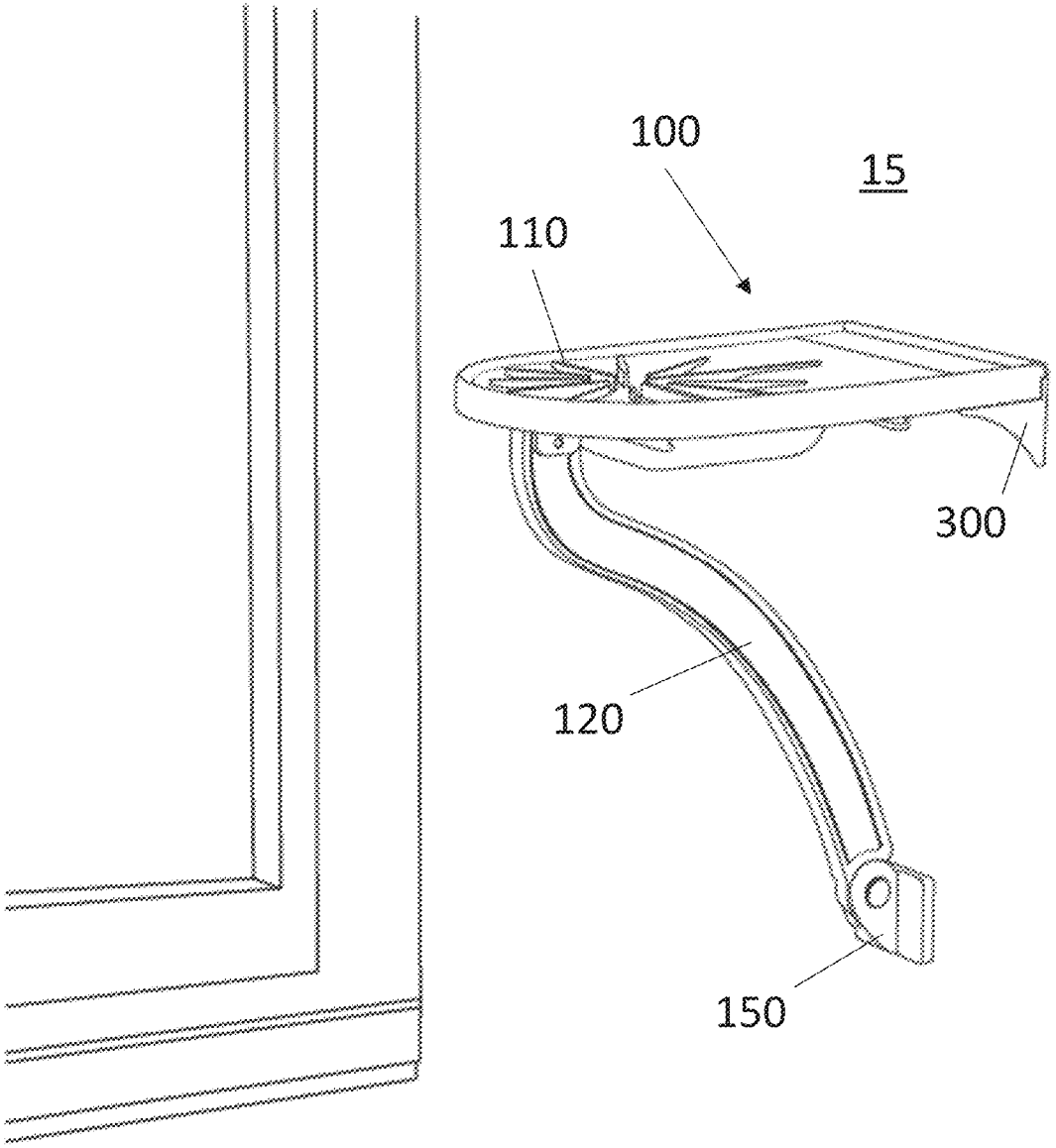
FIG. 5 is a view of a third step in assembling the plant caddy shelf.
Figure 6:
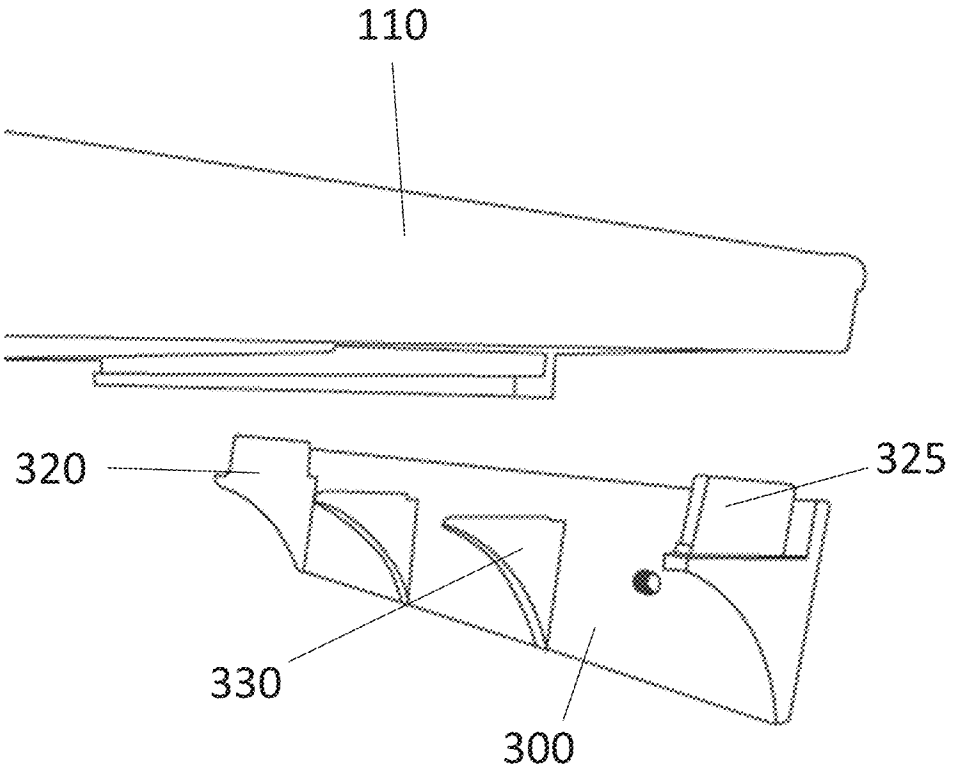
FIG. 6 is a view showing attachment of the main platform to a wall bracket.

There are two different manners in which the plant caddy shelf 100 can be used. In a first type of installation, the plant caddy shelf 100 sits on a window sill 10 as shown in FIG. 4, while in a second type of installation, the plant caddy shelf 100 is secured to a support surface, such as a wall 15 in a house as shown in FIG. 5. As mentioned herein, in the second type of installation, the wall bracket 300 is used.

Figure 7A:
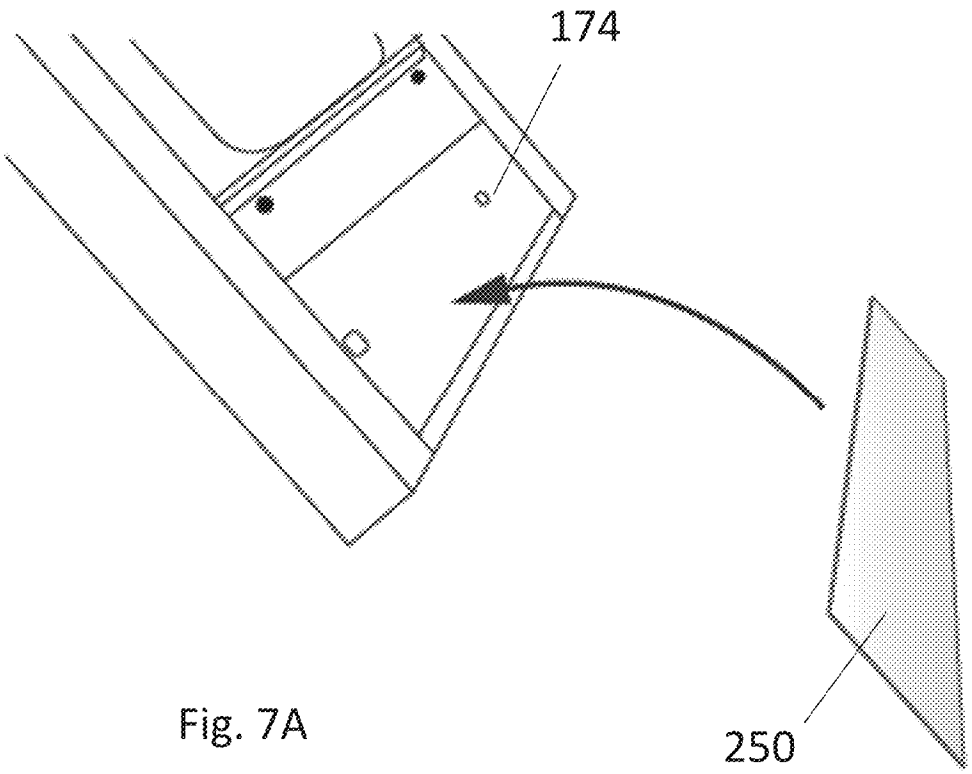
FIGS. 7A and 7B are views of a fourth step in assembling the plant caddy shelf.
Figure 7B:
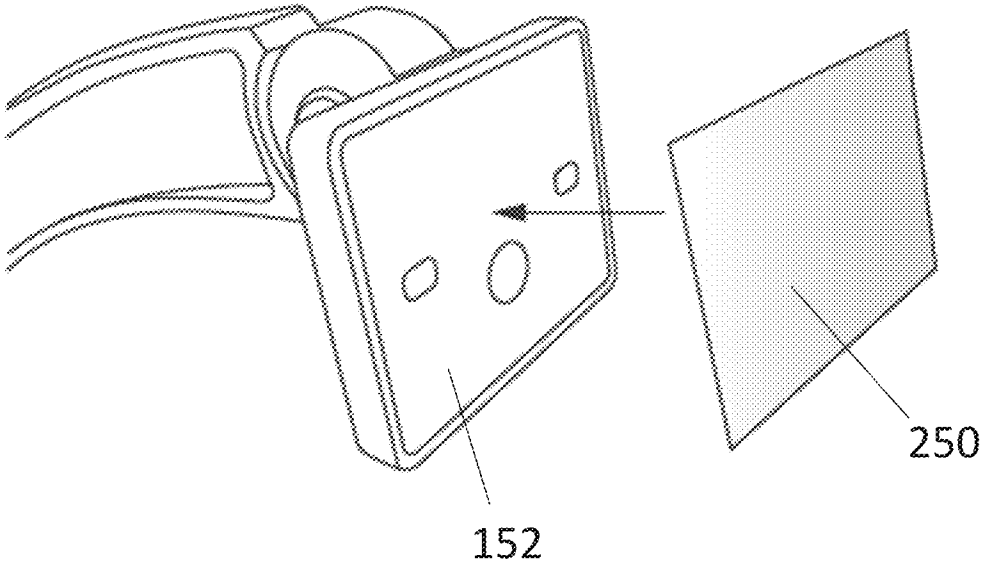

As shown in FIG. 4, when the plant caddy shelf 100 sits on the window sill 10, the rear of the main platform 110 is placed on the window sill 10 and then the pivotable support leg 120 is positioned relative to the wall 15. One of the locating walls 111 (i.e., the one closest to the rear edge that can be located 2.75 inches from the rear) can be used as a placement guide. Once the desired location has been selected, the user ensures that the main platform 110 is straight and level prior to installation with the fastener component (e.g., adhesive strips or screws). As shown in FIGS. 7A and 7B, when adhesive strips 250 are used, the large adhesive strip can be placed on the bottom surface 114 of the main platform 110 at or along the rear edge (FIG. 7A). The small adhesive strip is placed on the mounting portion 152 (FIG. 7B). In this type of installation, the rear of the main platform 110 is supported by the window sill 10, while the front of the main platform 110 is supported by the pivotable support leg 120.

When screws are used (FIG. 8A), the back plate 170 that is part of the main platform 110 is removed, to expose the inner compartment 172 that includes holes 174. The back plate 170 defines the rear edge of the main platform 110. Screws are then inserted through holes 174 for mounting the rear portion of the main platform 110 to the window sill 10.

The wall bracket 300 is not used for a window sill installation.

Figure 8A:
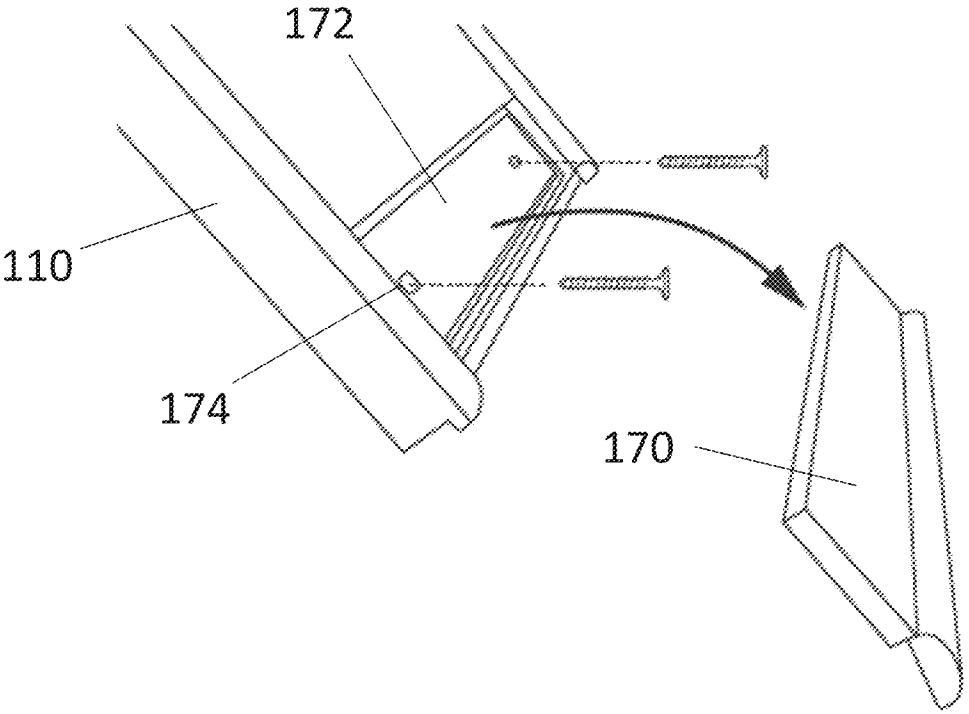
FIGS. 8A and 8B are views of a fifth step in assembling the plant caddy shelf.
Figure 8B:
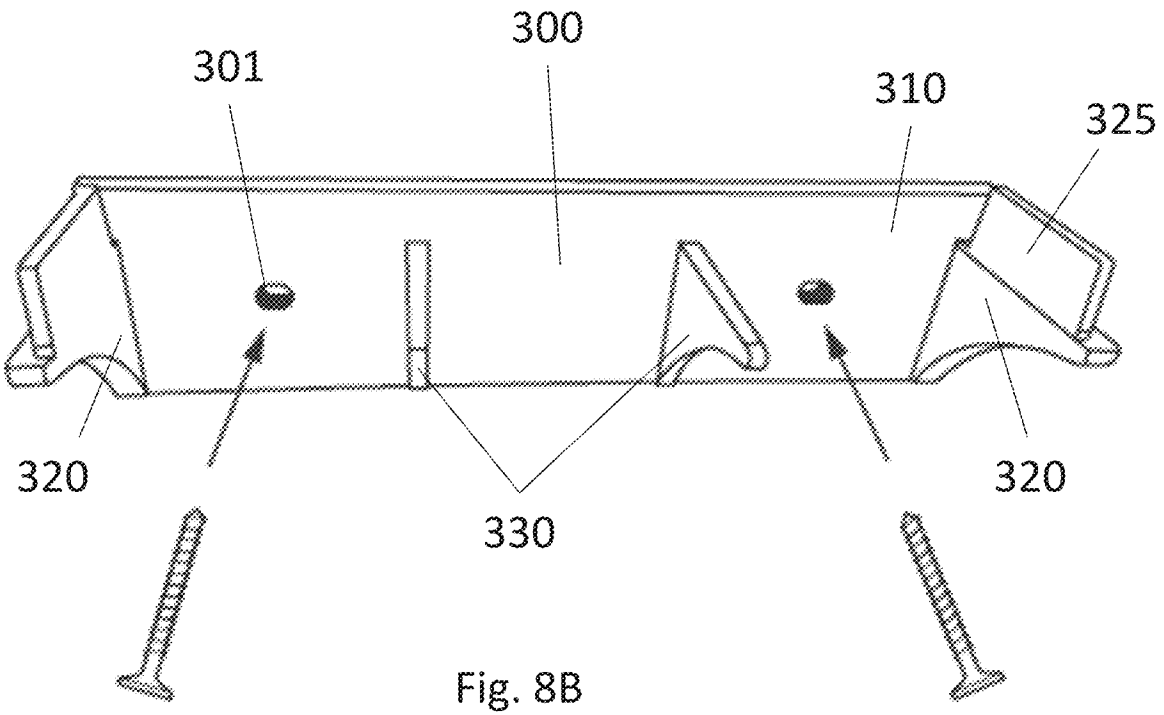
Figure 9:
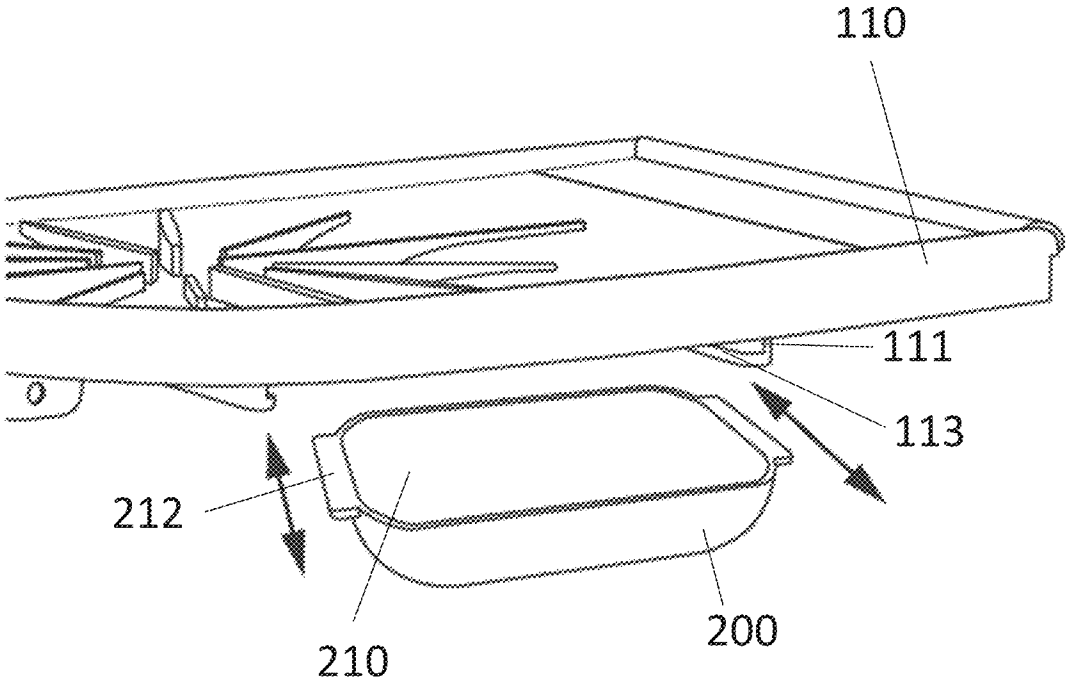
FIG. 9 is a side perspective view of the plant caddy shelf with a slide out drip tray being removed.
Figure 10:
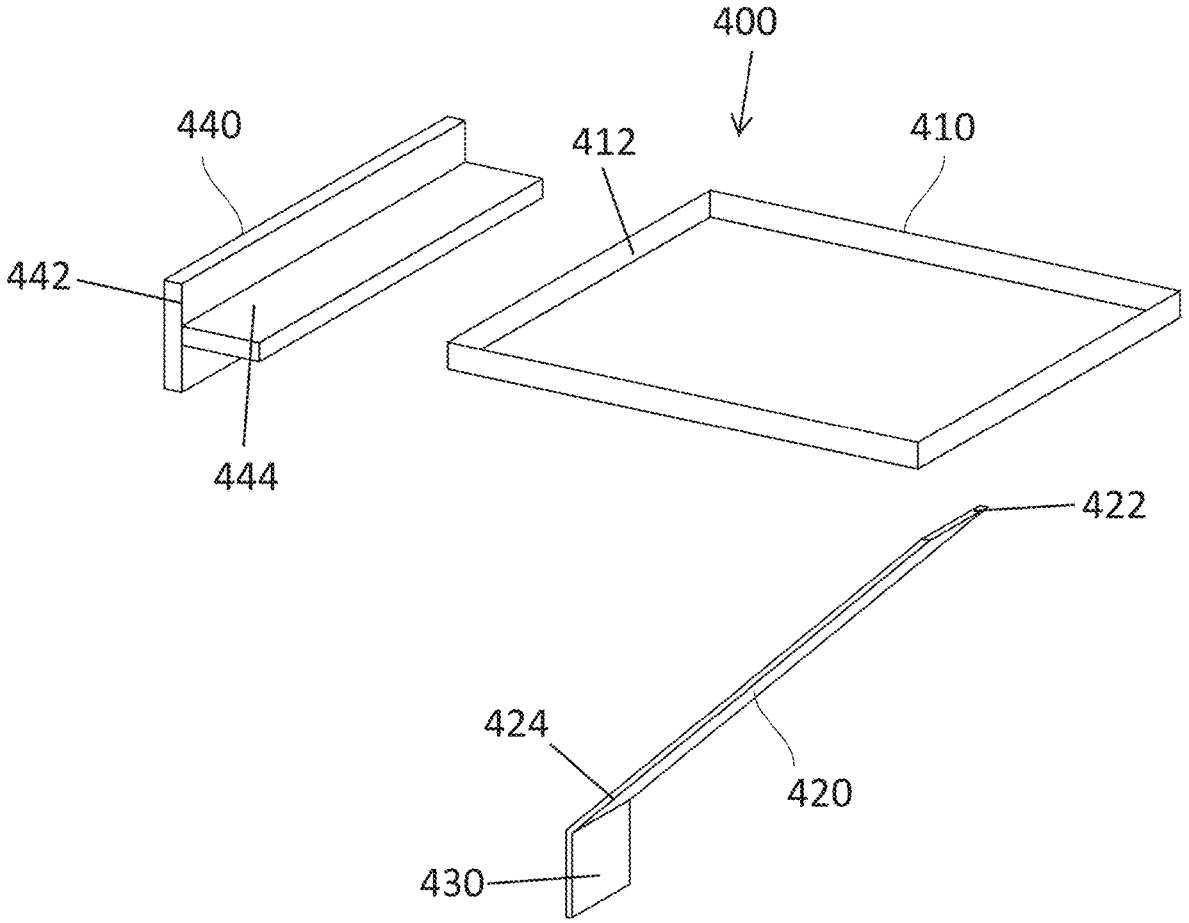
FIG. 10 is an exploded perspective view a plant caddy shelf according to another embodiment.

As shown in FIG. 5, when the plant caddy shelf 100 is installed on the support surface (wall 15), the wall bracket 300 is used. The fastening components that are used to attach the wall bracket 300 to the wall 15 can be either adhesive strips or screws. As described herein and shown in FIG. 6, to couple the main platform 110 to the wall bracket 300, the main platform 110 is simply lowered to cause a reception of the end tabs 325 into the slots, thereby locking the main platform 110 to the wall bracket 300. The intermediate supports 330 support the inner section of the main platform 110. When adhesive strips are used, the large adhesive strip is positioned along the rear face of the rear wall of the rear bracket 300 and the small adhesive strip is placed on the mounting portion 152. It is important to ensure that the rear bracket 300 is level and that the installed main platform 110 is straight and level. As shown in FIG. 8B, when screws are used, the screws are inserted through the holes formed in the rear bracket 300.

It will be appreciated that when screws are used, screw anchors can likewise be used.

Now turning to FIGS. 10-14 in which a plant caddy shelf 400 according to another embodiment is shown. The plant caddy shelf 400 includes a platform 410 that has a raised perimeter lip or perimeter edge 412. The platform 410 can take different shapes and sizes with the illustrated embodiment, being square shaped.

The plant caddy shelf 400 further has a support bracket 420 that has a first end 422 that is coupled to an underside of the platform 410 and an opposite second end 424 that terminates in a mounting portion 430. The mounting portion 430 is set at an angle to the support bracket 420. The mounting portion 430 is to seat flush against a support surface such as a wall with the first end 422 supporting the weight of the platform 410.

The plant caddy shelf 400 can optionally include an adapter 440 for use in certain mounting/installation scenarios as described herein. The adapter 440 can be T-shaped with a first wall 442 and a second wall 444 that is formed perpendicular to the first wall 442. The second wall 444 can be centrally located along the first wall 442.

Figure 11:
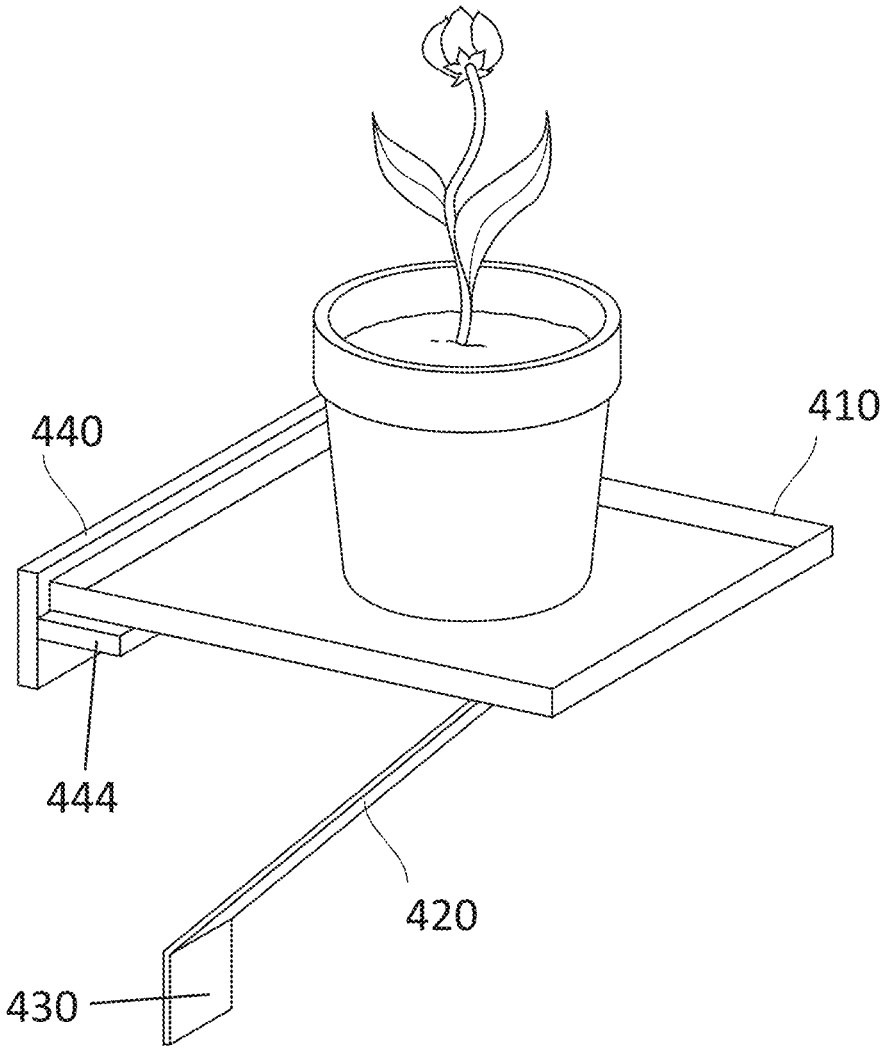
FIG. 11 is a perspective view of the assembled plant caddy shelf.

FIG. 11 shows the platform 410 supported by the second wall 444 of the adapter 440. As described herein, the platform 410 can be coupled to the second wall 444 using any number of techniques, such as adhesive strips, hook and loop, etc.

Figure 12:
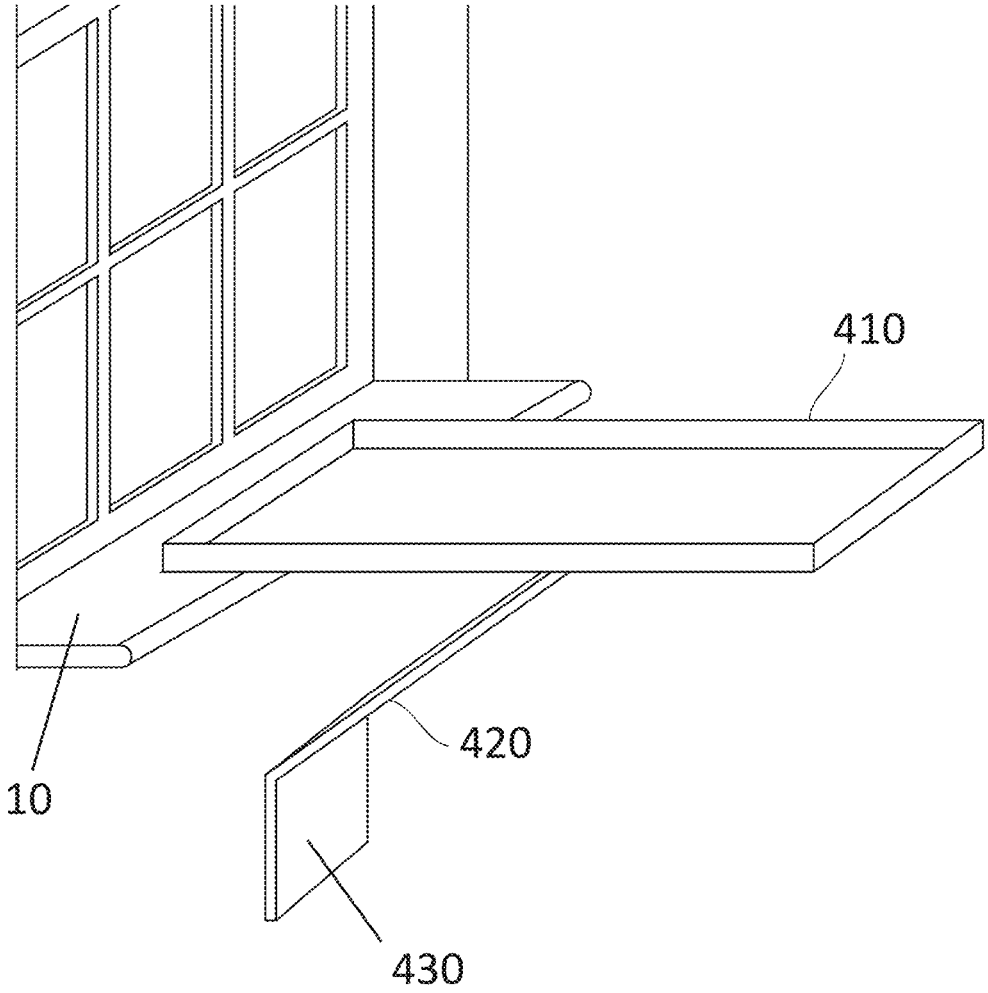
FIG. 12 is a side perspective showing the plant caddy shelf installed on a window sill.

FIG. 12 shows the platform 410 resting on the window sill 10.

Figure 13:
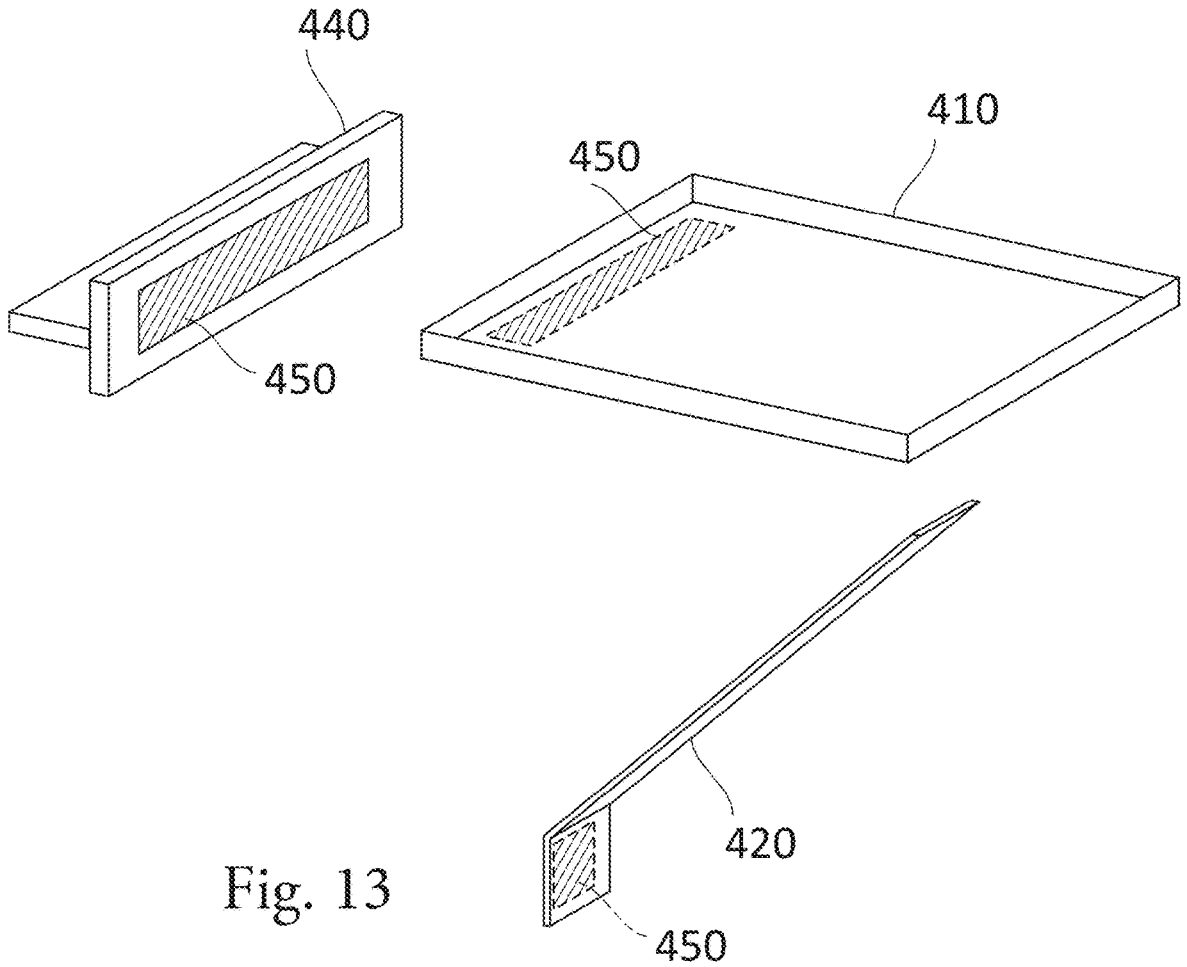
FIG. 13 is a bottom perspective view of the plant caddy shelf.

FIG. 13 shows the use of joining components 450 such as adhesive strips (double sided tape) that can be located along the underside of the platform 410 and along the rear face of the first wall 442. One joining component 450 can be located along the rear of the mounting portion 430.

The adapter 440 is attached to a vertical surface with the joining component 450 in a horizontal position to allow reception of the platform edge. The adapter 440 provides a support anchor for the platform 410 to rest upon. The platform 410 and the bracket 420 can be connected by a flexible/pivoting connection. The platform/bracket combination is then attached to the adapter 440, jutting perpendicular from the wall, in a predominately horizontal position to form a shelf. The end of the bracket 420 that is furthest away from the shelf then is attached to the same vertical surface with the joining component 450 to form a support for the end of the platform 410.

Each component can be made of any number of material such as wood, metal, plastics, composites, glass, ceramics or other materials that provide the structural integrity required to fulfill the device's intended purpose.

The platform 410 is predominately four-sided with sides being predominately parallel. The bracket 420 is predominately four-sided with sides being predominately parallel.

The adapter 440 is predominately four-sided with sides being predominately parallel.

Each component can have single or multiple pieces that form its embodiment.

Figure 14:
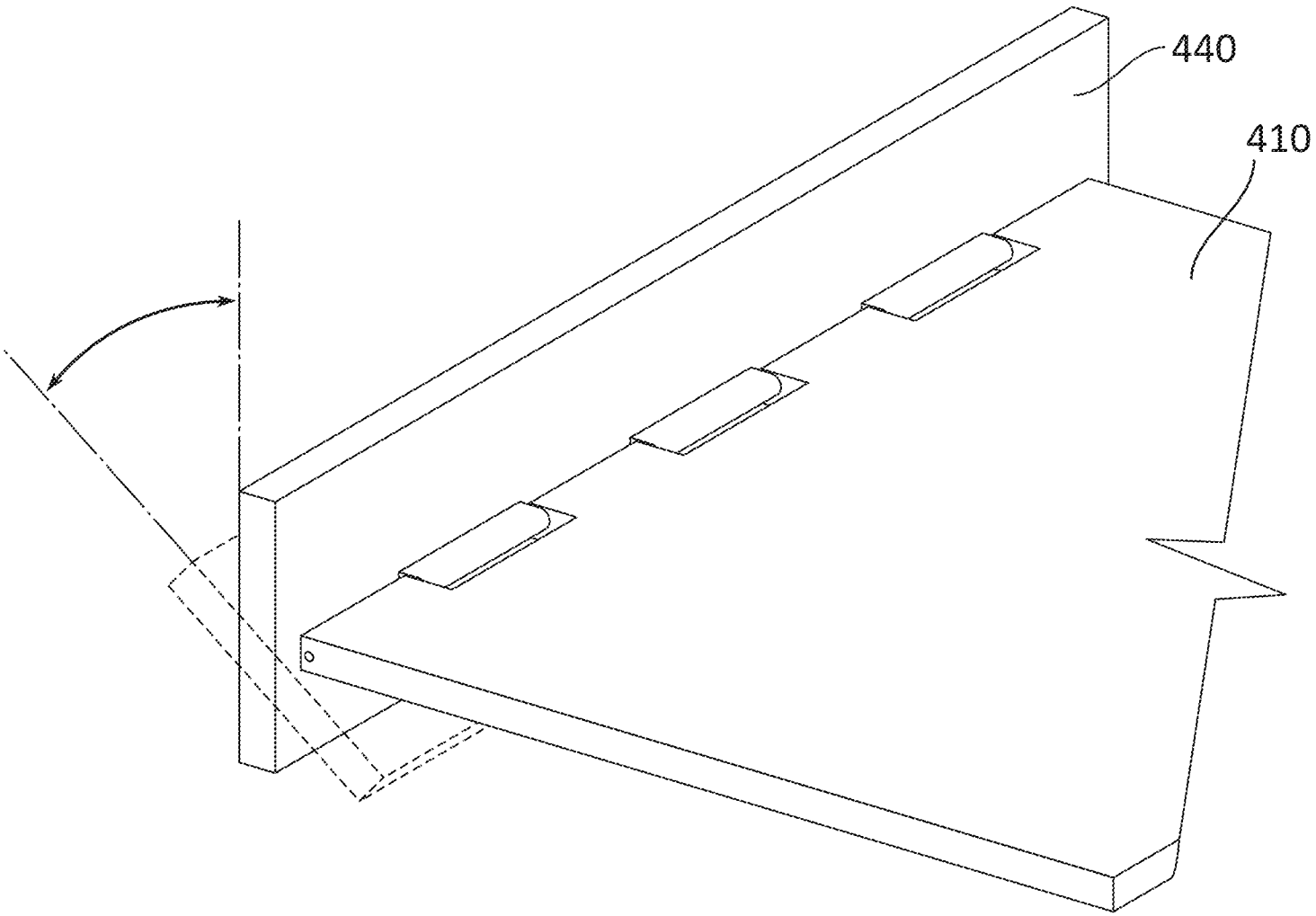
FIG. 14 shows adjustability of a platform of the plant caddy shelf.

The platform 410 and the adapter 440 can be mechanically attached by way of a hinging system (See, FIG. 14). The platform 410 and the adapter 440 can be combined by a each having a shape that coordinates together to form a hinging function.

The device (shelf 400) can have provisions for a variety of methods to attach to one another. One method to may create a configuration into the actual components themselves that allow the components to join themselves together by the inherent nature of the shape they are molded. These configurations may include fittings, slots, pivots, swivels, hinges, couplers, brackets, hollowed openings or other similar configurations. Another method to join the components together may include, but not limited to, the use of magnets, adhesives, clips, snaps, buttons, brackets, hinges, hook/ loop material, screws, bolts, nails, adhesive tapes or similar adhesive products.

Another method can be to combine any of these components together into one component. As an example, this may include incorporating the adaptor directly into the platform to essentially create a single piece that performs the function of both components. For example, this also may include incorporating the bracket into the platform.

The device may utilize a variety of options to attach to the intended surface. These may include, but are not limited to, magnets, adhesives, hook/ loop material, gels, tape, screws, nails, hooks, or bolts.

The joining component 450 can consist of any variety of magnets, adhesives, clips, snaps, buttons, brackets, hinges, hook/ loop material, screws, bolts, nails, adhesive tapes or similar adhesive products.

It is also disclosed that the adapter 440 cannot be required to be used in every location. It can be installed onto a horizontal surface, such as a window sill, desk or countertop. The remaining bracket 420 can then supply the intended support.

The platform 410 of the disclosed device may have raised edges to retain items on the platform.

Each component of this system may be of any length, width, diameter or thickness.

Each component may be of any shape. Shapes include, but are not limited to, cylinders, cuboids, spheres, cones, pyramids, cubes and prisms.

The disclosed device is unique when compared with other known devices and solutions because it provides: (1) a platform that is able to be installed without construction knowledge; (2) a platform that is able to be installed without construction tools; (3) a platform that can be mounted to a variety of surfaces.

The disclosed device is unique in that it is structurally different from other known devices or solutions. More specifically, the device is unique due to the presence of: (1) a platform 410 that is able to be attached to most any surface (2) and a design that allows a user to install the system without tools.

It is noted that the components of this system may alternatively be shaped as a diamond, a circle, an oval, polygon or any other known shapes. The shape being selected based on the desired performance.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The Universal Platform may, however, be embodied in many different forms and should not be construed as being limited to the embodiments set forth herein; rather, these embodiments are provided by way of illustration only and so that this disclosure will be thorough, complete and fully convey understanding to those skilled in the art.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

What is claimed is:

1. An article for supporting a plant comprising:

a main support platform that is configured for placement on a top surface of a window sill, the main support platform having an area for receiving a plant pot, the area including a drain hole;

a leg support being pivotally coupled at a top end to an underside of the main support platform and including a bottom end for coupling to a support surface;

a removable drip tray that is removably coupled to the underside of the main support platform and is in fluid communication with the drain hole; and a wall bracket that has a back wall with a pair of end walls that are oriented perpendicular to the back wall, each end wall has an upstanding end tab that extends above a top edge of the back wall, the end tabs being configured to be received within slots formed along the underside of the main support platform for coupling the main support platform to the wall bracket.

2. The article of claim 1, wherein the top end of the leg support is snap-fittingly coupled to the underside.

3. The article of claim 1, wherein the underside of the main support platform has a pair of rails each of which has an inwardly directed first lip on which a second lip that is part of the drip tray rests and slidingly travels.

4. The article of claim 1, wherein the main support platform has a removable back plate that exposes an inner compartment in which a pair of holes are formed for receiving fasteners for fixedly securing the main support platform to the window sill.

5. The article of claim 1, wherein the bottom end includes a pivotable mounting portion that has a mounting surface on which an adhesive strip is disposed.

6. The article of claim 1, wherein the end tab is integral to the end wall and comprises a fin structure for reception in the slots that have rectilinear shapes.

7. The article of claim 1, wherein the wall bracket includes intermediate supports that are located between the end walls, the intermediate supports have flat edges on which the underside of the main support platform rests.

8. The article of claim 1, wherein the leg support has an S-shape defined by a first curvature that terminates at the upper end and a second curvature at the bottom end.

9. The article of claim 8, wherein the drain hole is centrally located within the plurality of raised ribs.

10. The article of claim 1, wherein a top surface of the main support platform includes a plurality of raised ribs arranged in a pattern to define the area for receiving the plant pot.

11. The article of claim 1, wherein the main support platform includes a perimeter lip that extends continuously around a perimeter of the main support platform.

12. The article of claim 11, wherein a top surface of the main support platform includes a plurality of raised ribs arranged in a pattern to define the area for receiving the plant pot, wherein a height of each raised rib is less than a height of the perimeter lip.

13. An article for supporting a plant comprising:

a main support platform that is configured for placement on a top surface of a window sill, the main support platform having an area for receiving a plant pot, the area including a drain hole, the main support platform including a removable back plate that defines a rear upper portion of the main support platform and the removable back plate is disposed over an inner compartment in which a pair of holes are formed for receiving fasteners for fixedly securing the main support platform to the window sill;

a leg support being pivotally coupled at a top end to an underside of the main support platform proximate a front edge of the main support platform and including a bottom end, the leg support having a first curved portion that is curved in a first direction and terminates in the top end and a second curved portion that is curved in a second direction and terminates in the bottom end;

a mount pivotally coupled to the bottom end of the leg support, the mount having a flat rear mounting surface for placement against a support surface; and a removable drip tray that is removably coupled to the underside of the main support platform and is in fluid communication with the drain hole, the drip tray being entirely contained between opposing sides of the main support platform;

wherein the underside includes a rear section through which the pair of holes pass, the rear section receiving an adhesive strip that covers the pair of holes.

14. The article of claim 13, wherein the top end of the leg support snap-fits with a coupling member formed along the underside of the main support platform, the top end having a pair of pins that snap-fit with notches formed in upstanding walls that define the coupling member to permit rotation of the pins in the notches.

15. The article of claim 13, wherein the underside includes at least one raised locating rib that extends transversely across the underside between the opposing sides.

* * * * *